US011940240B2

(12) United States Patent
Makowski et al.

(10) Patent No.: US 11,940,240 B2
(45) Date of Patent: Mar. 26, 2024

(54) CUSTOMIZABLE FIREARM SYSTEM

(71) Applicant: MAK IP, LLC, Cardington, OH (US)

(72) Inventors: Brandon Makowski, Cardington, OH (US); Dewayne Lee Thompson, Gainesville, FL (US)

(73) Assignee: MAK IP, LLC, Cardington, OH (US)

( * ) Notice: Subject to any disclaimer, the term of this patent is extended or adjusted under 35 U.S.C. 154(b) by 0 days.

(21) Appl. No.: 17/972,159

(22) Filed: Oct. 24, 2022

(65) Prior Publication Data

US 2023/0128014 A1 Apr. 27, 2023

Related U.S. Application Data

(60) Provisional application No. 63/270,619, filed on Oct. 22, 2021.

(51) Int. Cl.

| | |
|---|---|
| ***F41A 3/66*** | (2006.01) |
| ***F41A 3/72*** | (2006.01) |
| ***F41A 3/88*** | (2006.01) |
| ***F41A 19/10*** | (2006.01) |
| ***F41A 21/48*** | (2006.01) |

(52) U.S. Cl.

CPC ..... *F41A 3/72* (2013.01); *F41A 3/66* (2013.01); *F41A 3/88* (2013.01); *F41A 19/10* (2013.01); *F41A 21/48* (2013.01)

(58) Field of Classification Search

CPC ..... F41A 3/66
USPC ..... 72/71.01
See application file for complete search history.

(56) References Cited

U.S. PATENT DOCUMENTS

| | | | | |
|---|---|---|---|---|
| 10,753,692 | B1 | 8/2020 | Thompson | |
| 11,255,633 | B2 * | 2/2022 | Alber | F41A 11/02 |
| 2012/0097016 | A1 | 4/2012 | Eaglestone | |
| 2014/0033590 | A1 | 2/2014 | Gomez | |
| 2014/0331853 | A1 | 11/2014 | St. George | |
| 2015/0090105 | A1 | 4/2015 | Pace | |
| 2016/0033218 | A1 | 2/2016 | Folkestad, II et al. | |
| 2021/0180904 | A1 | 6/2021 | Bray | |

OTHER PUBLICATIONS

Written Opinion of the International Searching Authority dated Jul. 24, 2023.

* cited by examiner

*Primary Examiner* — Reginald S Tillman, Jr.
(74) *Attorney, Agent, or Firm* — Jacob M. Ward; Ward Law Office LLC

(57) ABSTRACT

A customizable firearm system includes a chassis. A barrel assembly is disposed in the chassis. The barrel assembly including a trunnion and a barrel nut assembly. The barrel nut assembly includes an outer barrel nut sleeve and an inner barrel nut sleeve receiving a barrel. The barrel nut assembly is removably disposed in the trunnion. A bolt carrier assembly is disposed in the chassis. The bolt carrier assembly includes a backplate assembly and a pair of guide rods. Each of the guide rods have a first end disposed in the backplate assembly, and a second end disposed in the trunnion. A bolt carrier slidably disposed on the guide rod.

10 Claims, 7 Drawing Sheets

CUSTOMIZABLE FIREARM SYSTEM

CROSS-REFERENCE TO RELATED APPLICATIONS

This application claims the benefit of U.S. Provisional Application No. 63/270,619, filed on Oct. 22, 2021. The entire disclosure of the above application is incorporated herein by reference.

FIELD

The present disclosure relates to firearms and, more specifically, to a customizable firearm system.

INTRODUCTION

This section provides background information related to the present disclosure which is not necessarily prior art.

There are a number of automatic and semi-automatic rifles used by military personnel as well as law enforcement and civilians. While fully automatic rifles are generally illegal for use by the civilian population, many of the components which constitute an automatic rifle are the same as those found within semi-automatic models legalized for civilian use. Arguably the most popular semi-automatic assault-type rifle used by civilians, particularly within the United States, is the AR-15. The AR-15 is the semi-automatic variant of the fully automatic M16 rifle used by United States military personnel.

The AR-15 and M16 are designed as modular rifles generally comprising a buttstock, lower receiver, upper receiver and barrel assembly. Each component is separable from one another and affords rifle owners the opportunity to customize the rifle with after-market components such as barrels of differing lengths, upper receivers designed to handle different calibers of ammunition, flashlights, hand guards, grenade or flare launchers, flash or sound suppressors, grips, and front or rear sights. To operate, the lower receiver is configured to include a trigger and magazine box wherein activation of the trigger causes a round (bullet) housed within the chamber of the upper receiver to be fired out the barrel of the rifle by action of a reciprocating bolt carrier group housed within the upper receiver. Internal mechanisms of the upper receiver expel the shell casing of the fired round from the chamber while components engaged with the magazine box housed within the lower receiver feed a new round into the now-empty chamber. The buttstock mounts to the lower receiver and includes a buffer assembly and action (or recoil) spring in communication with the bolt carrier group. After a spent shell has been discharged, the spring urges the bolt carrier group back toward the chamber in preparation for firing another round.

The modular construction of these rifles enables generally quick and easy fieldstripping (disassembly of the rifle for cleaning of the rifle to ensure proper firing of the weapon). In field-stripping the rifle, the lower receiver is separated from the upper receiver to gain access to the firing mechanism (bolt, bolt carrier, and associated mechanisms) for cleaning and re-lubrication. When assembled, the upper and lower receivers are secured to one another through rear and forward extensions on the upper receiver fitting between corresponding sidewalls forming notches or grooves on the lower receiver. The forward sidewalls and extension are fitted with a pivot pin to prevent the forward halves of the receivers from separating. Similarly, the rear sidewalls and extension employ a takedown pin to secure the two receivers together. To fieldstrip the rifle, the takedown pin is sufficiently pushed out of the extension so as to enable the rear extension to lift out of the rear sidewalls thereby pivoting the lower and upper receivers about the pivot pin. The pivot pin can then be pushed out a sufficient distance so as to enable removal of the front extension from the front sidewalls and thereby completing separation of the lower receiver from the upper receiver.

A bullpup is a firearm with its action behind its trigger group. This configuration permits a shorter overall weapon for a given barrel length. This maintains the advantages of a longer barrel in muzzle velocity and accuracy, while improving maneuverability and reducing weight. The entire magazine is often also located behind the trigger group, though it is only necessary for the weapon's feed location to be located there for it to be classified as a bullpup. Being held closer to the body, a bullpup causes less arm fatigue and allows faster reaction time from a lowered position.

Current bullpup style firearms on the market have very few offerings of barrel choices, and when offered, generally at a high cost. These few offerings limit the ability of a user to choose barrel length, caliber, twist rates, muzzle threading, and other characteristics one may require.

Modern firearms of the AR family and derivatives are well-known for their ability to be purpose-built to perform specific tasks. With an unknown limit on barrel configurations, users are able to build these firearms in short configurations, possibly for home defense, or longer configurations, possibly for competition target shooting, with an ever-expanding list of caliber options. However, it is often that general users find themselves sacrificing distance capabilities for confined space mobility.

There is a need for a customizable firearm system in a bullpup configuration, which allows for integration of existing firearm components, including AR components.

SUMMARY

In concordance with the instant disclosure, a customizable firearm system, which allows for integration of existing AR components, has been surprisingly discovered.

The present invention allows existing barrel types to be used in the compact bullpup style firearm, which allows users to use a longer barrel in a firearm with a shorter overall length. This allows for use of existing barrels that are readily available, affordable, and have vast options.

In one embodiment, a customizable firearm system includes a chassis. A barrel assembly is disposed in the chassis, the barrel assembly including a trunnion and a barrel nut assembly. The barrel nut assembly includes an outer barrel nut sleeve and an inner barrel nut sleeve receiving a barrel. The barrel nut assembly is removably disposed in the trunnion.

In another embodiment, a customizable firearm system includes a chassis. The barrel nut assembly is removably disposed in the trunnion. A bolt carrier assembly is disposed in the chassis. The bolt carrier assembly includes a backplate assembly and a pair of guide rods. Each of the guide rods have a first end disposed in the backplate assembly, and a second end disposed in a trunnion. The bolt carrier is slidably disposed on the guide rod.

In a further embodiment, a customizable firearm system includes a chassis. A barrel assembly is disposed in the chassis, the barrel assembly including a trunnion and a barrel nut assembly. The barrel nut assembly includes an outer barrel nut sleeve and an inner barrel nut sleeve receiving a barrel. The barrel nut assembly is removably disposed in the trunnion. A bolt carrier assembly is disposed in the chassis. The bolt carrier assembly includes a backplate assembly and a pair of guide rods. Each of the guide rods has a first end disposed in the backplate assembly, and a second end disposed in the trunnion. A bolt carrier is slidably disposed on the guide rod.

In an exemplary embodiment, the firearm system can include a quick-change barrel assembly. The barrel assembly can include a trunnion and a barrel nut assembly. The barrel nut assembly can be configured to receive a barrel. The barrel nut assembly can also be configured to be disposed within the trunnion. The barrel nut assembly can include an outer barrel nut sleeve and an inner barrel nut sleeve. The outer barrel nut sleeve can be configured to be slidably inserted into the trunnion. The outer barrel nut sleeve can include an aperture configured to guide and support a gas tube or line. The inner barrel nut sleeve can be threadably secured into the outer barrel nut sleeve. In operation, the barrel can be inserted into the outer barrel nut sleeve, and the inner barrel nut sleeve can be disposed around the barrel and in the outer barrel nut sleeve. The inner barrel nut sleeve can then be twisted into place along the threads. In this way, the outer barrel nut sleeve and the inner barrel nut sleeve can cooperate to secure the barrel in place within the barrel assembly. Advantageously, the two-sleeve barrel nut system (outer barrel nut sleeve and inner barrel nut sleeve) can allow a standard AR barrel to be utilized with the customizable firearm system. Additionally, dimensions of the inner barrel nut sleeve can be configured to receive additional barrel types, where corresponding changes can be made to the configuration of the outer barrel nut sleeve, as desired.

The quick-change barrel assembly can further include a release system. The release system can include a lever in communication with a rod. The rod can include a cut-out portion. The rod can be disposed below the trunnion and barrel nut assembly. Each of the trunnion and the outer barrel nut sleeve can have a divot formed therein. The rod can be configured to be disposed in the divot. The lever can be configured to selectively rotate the rod. The lever can have a free end that can be disposed on an exterior of the chassis, such that the lever can be accessed by the user without removal of any components of the firearm. When rotated, the cutout of the rod can be aligned with the divot of the trunnion and the barrel nut assembly. When the cut-out and the divot are aligned, the user can slide the quick-change barrel assembly out of the chassis. In operation, additional components can be removed with the quick-change barrel assembly including a gas tube, a gas block, and a muzzle break.

It should be appreciated that the quick-change barrel system can be removed directly from the handrail of the firearm system. Advantageously, the quick-change barrel system can allow for a toolless removal of the barrel, in operation. A barrel can be swapped in less than a minute with no small parts at risk of being lost and the quick-change barrel system does not alter the state of any other accessories or critical components of the firearm.

The customizable firearm system can include a removable bolt carrier assembly. The bolt carrier assembly can include a bolt carrier, a pair of guide rods, a guide rod backplate, a pair of dampener rods, and a dampener rod backplate. Each of the guide rods and the dampener rods can have a spring disposed therein. Each of the guide rods can have a first end removably disposed on the trunnion and a second end disposed on the guide rod backplate. The bolt carrier can be slidably disposed on the pair of guide rods. The dampener rods can have a first end disposed in the bolt carrier and a second end disposed on the dampener rod backplate. Advantageously, the dampener rods and dampener rod backplate can provide recoil mitigation during operation of the firearm system. Additionally, the dampener rods and dampener rod backplate can serve as a timing lug should M16 fire control components (e.g., select-fire; 3 round burst; full auto) be utilized within the firearm system.

In operation, the bolt carrier can be pushed on the guide rods, from a home position to a distal position adjacent to the guide rod backplate. When moving from the home position to the distal position, the dampener rods can be collapsed into the bolt carrier until the dampening rod backplate is disposed adjacent to the bolt carrier. When the bolt carrier is in the distal position, the dampener rod backplate is disposed adjacent to the guide rod backplate and the bolt carrier is disposed toward the guide rod backplate.

It should be appreciated that the bolt carrier assembly can be configured to be removed from the chassis. The chassis can include a buttpad. The buttpad can be pivotable about the chassis. The buttpad can be secured to the chassis via a retaining pin. In operation, the retaining pin can be removed from the chassis, and the buttpad can be rotated away from the chassis. The bolt carrier assembly can be removed through an opening in a distal end of the chassis.

In certain embodiments, the customizable firearm system can include the quick-change barrel assembly and the bolt carrier assembly, each as described hereinabove. Advantageously, where both of the quick-change barrel assembly and the bolt carrier assembly are utilized, the firearm system can allow for a total caliber change of the firearm.

Where both of the quick-change barrel assembly and the bolt carrier assembly are utilized, one or more charging handles can be disposed around the trunnion. The one or more charging handles can be disposed on a cross bar, which is disposed on the bolt carrier. The one or more charging handles allow the user to move the bolt carrier assembly between the home position and the distal position, in operation.

The customizable firearm system can include a trigger mechanism. Advantageously, the trigger mechanism can be fabricated without a bow. The trigger can include an extended trigger barrel with an arm feature that connects to the trigger linkage. The trigger barrel can be in communication with a hammer.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Figure 1:
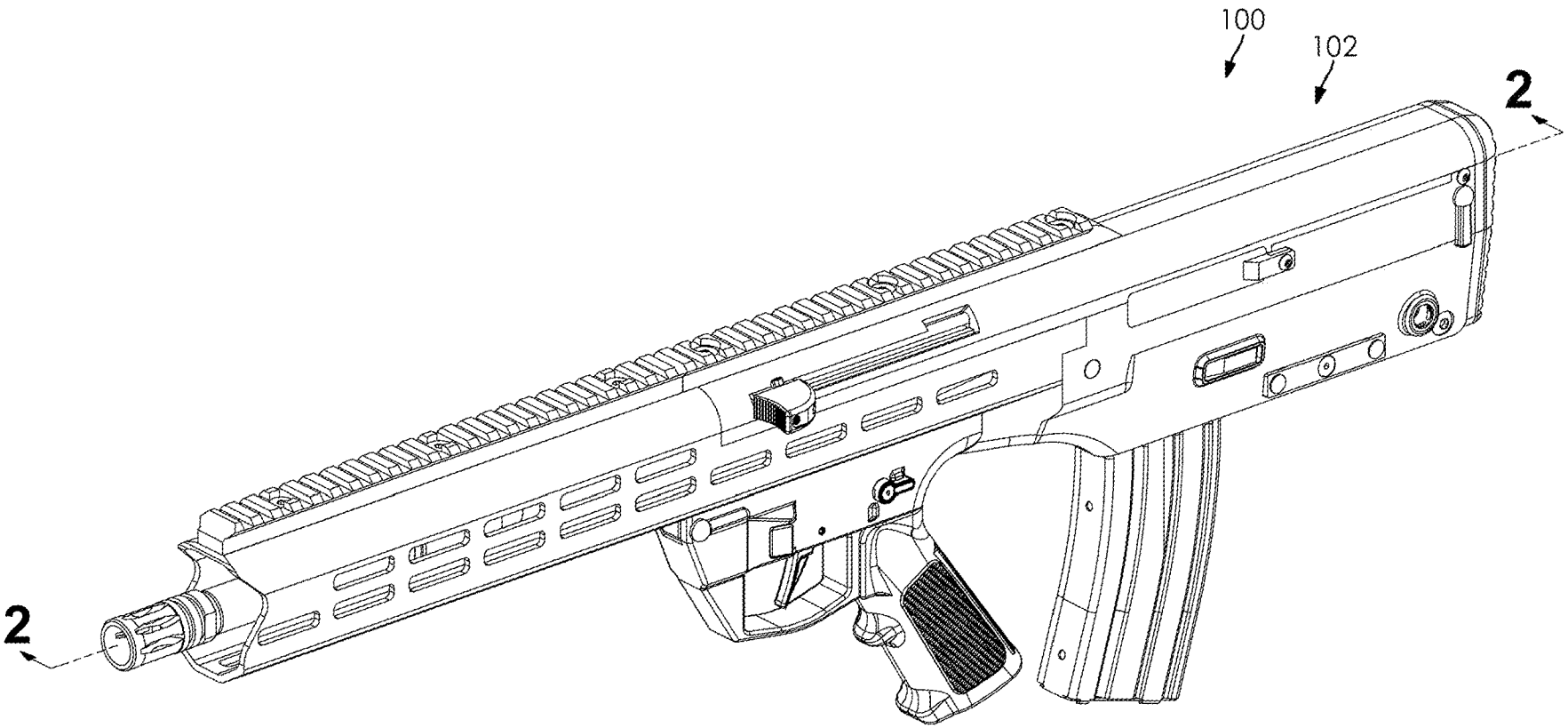
FIG. 1 is a top perspective view of a customizable firearm system, according to one embodiment of the present disclosure.
Figure 2:
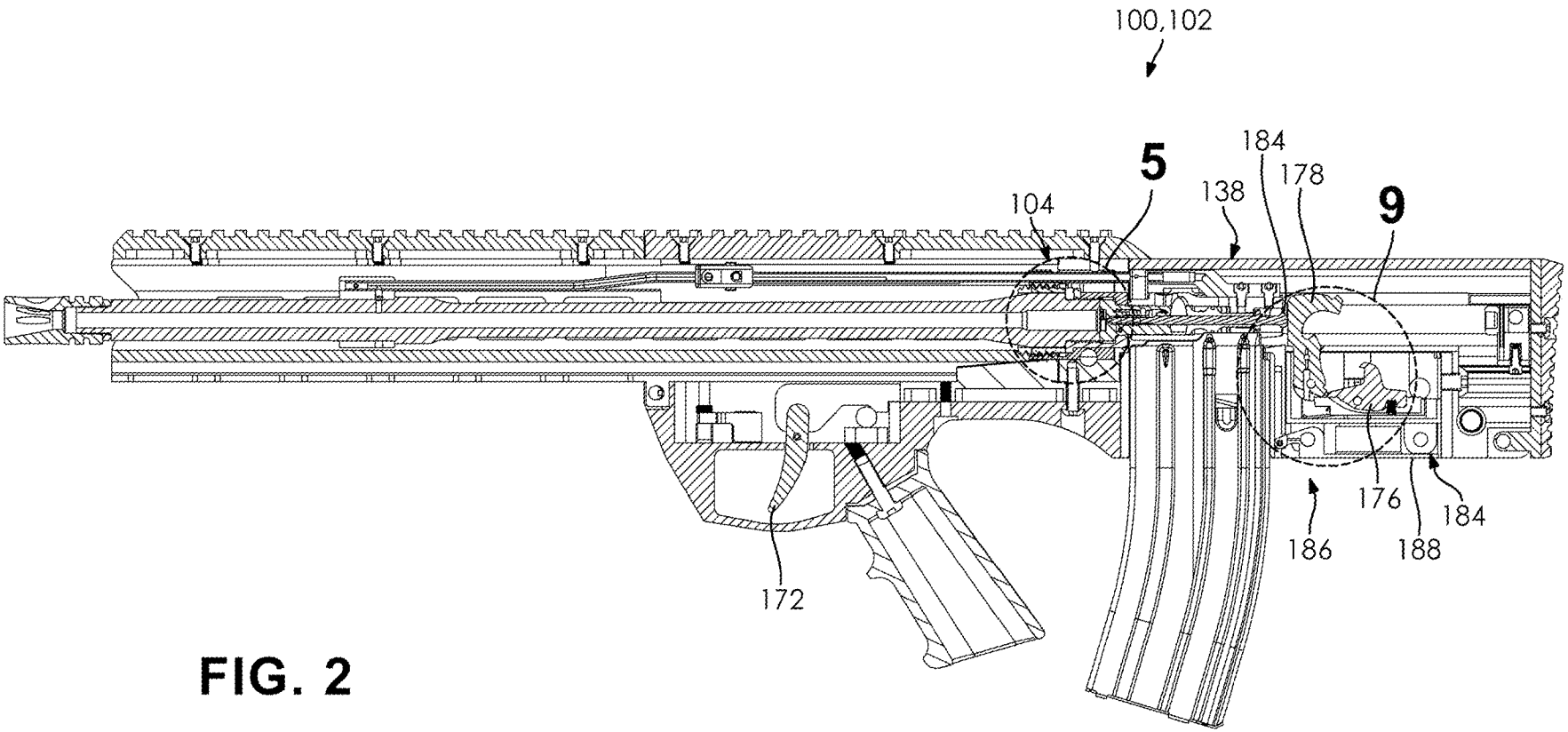
FIG. 2 is a cross sectional, side elevational view of the customizable firearm system taken at section line 2-2 in FIG. 1.
Figure 6:
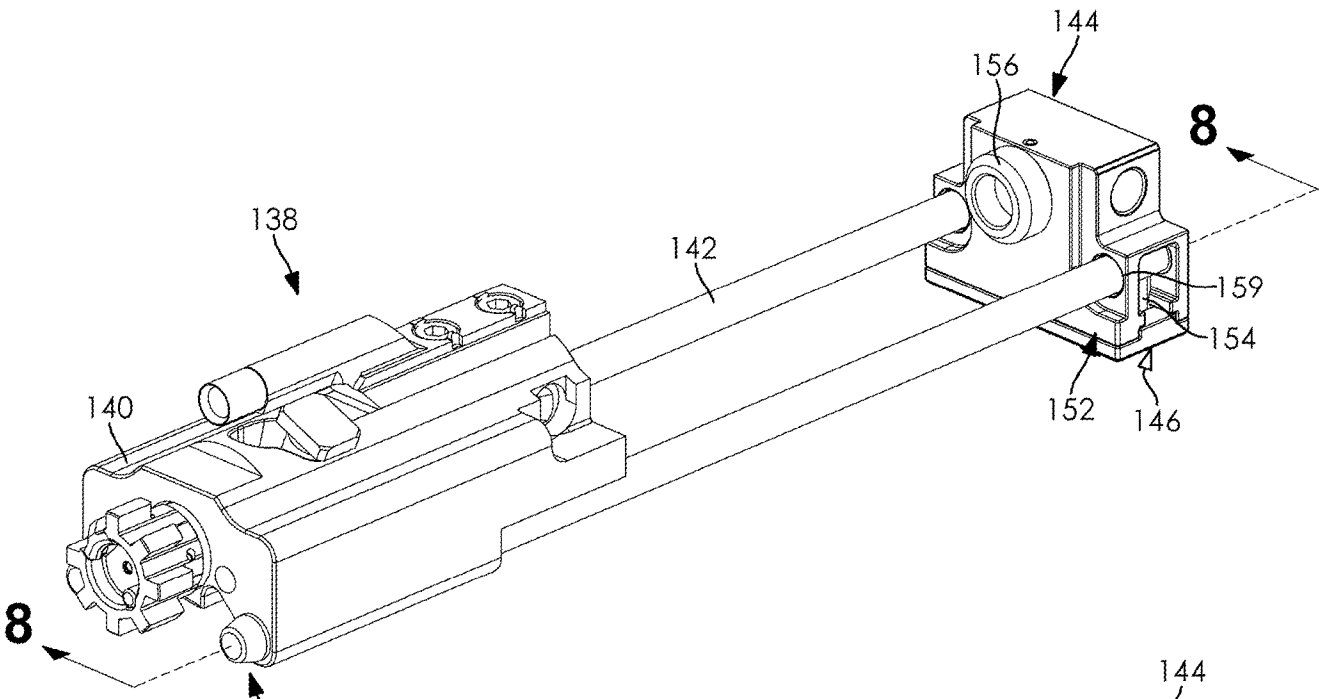
FIG. 6 is a top perspective view of a bolt carrier assembly of the customizable firearm system of FIG. 1, further depicted removed from the chassis, where the bolt carrier assembly includes a bolt carrier at one end and a back plate assembly at the other end.
Figure 8:
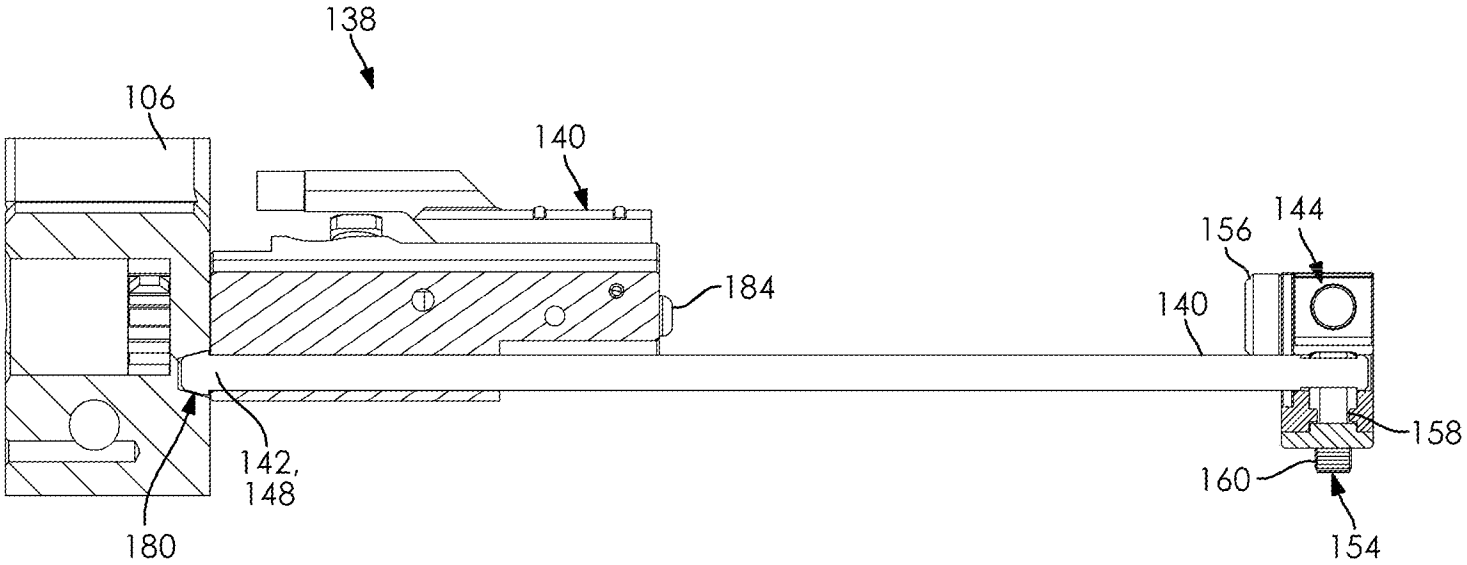
Figure 9:
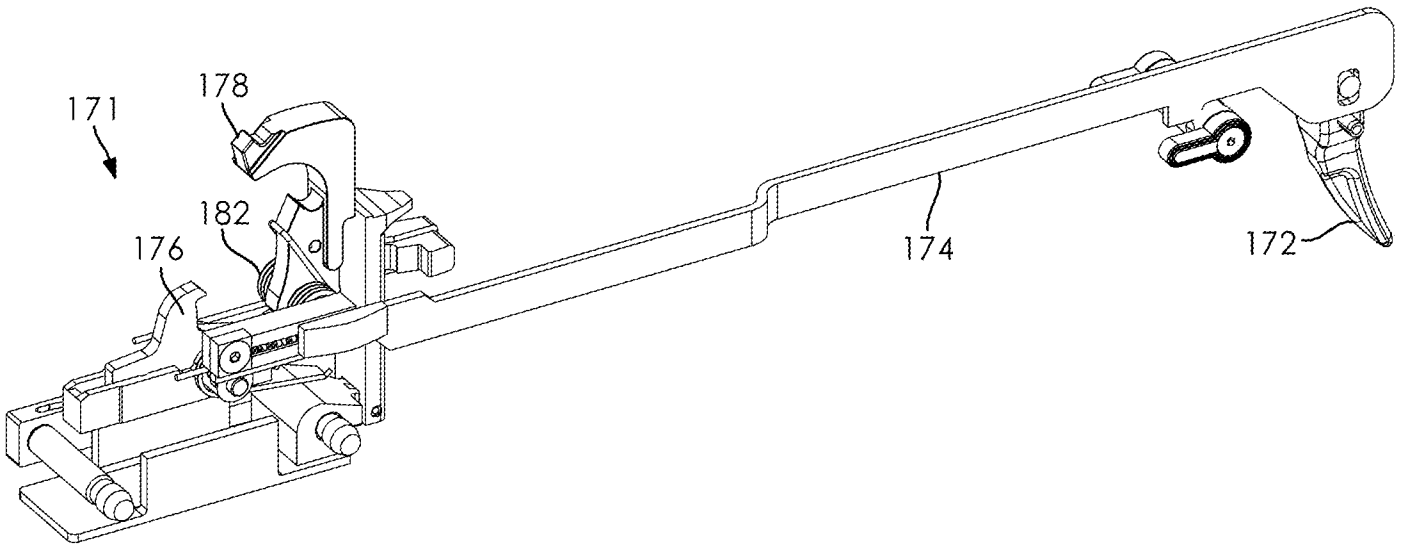

FIG. 8 is a cross sectional, side elevational view of the bolt carrier assembly, taken at section line 8-8 in FIG. 6; and FIG. 9 is a top perspective view of a trigger mechanism of the customizable firearm system of FIG. 1, further depicted removed from the chassis and rotated 180 degrees, including a portion taken at callout 9 in FIG. 2.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of an article of manufacture or process reciting elements A, B and C specifically envisions embodiments consisting of, and consisting essentially of, A, B and C, excluding an element D that may be recited in the art, even though element D is not explicitly described as being excluded herein.

Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-9, a customizable firearm system 100 according to an embodiment of the present disclosure is shown. The customizable firearm system 100 can include a chassis 102. In certain embodiments, the chassis 102 can be manufactured from precision machined lightweight, high-strength metals, alloys, plastics, composites, and advanced polymers, as non-limiting examples. A skilled artisan can tailor various dimensions, calibers, and accessories, as desired. Though the figures depict a bullpup style of firearm, it should be appreciated that other firearm configurations can be selected within the scope of the present disclosure. While used throughout the specification, it is to be understood that the term "AR" or "AR-15" is meant to include not only those rifles manufactured by Colt Industries, but also those additional clones and any variants thereof.

The firearm system 100 can include a barrel assembly 104. The barrel assembly 104 can be configured to be disposed in the chassis 102 of the firearm. The barrel assembly 104 can include a trunnion 106 and a barrel nut assembly 108, for example, as shown in FIGS. 2-5. The barrel nut assembly 108 can also be configured to be slidably disposed within the trunnion 106. In particular, the trunnion 106 can have a central bore 110 formed through a length of the trunnion 106. The central bore 110 can run from a barrel side 112 of the trunnion to a bolt side 114 of the trunnion. An internal lip 116 can be disposed on an interior surface of the trunnion 106 circumscribing the central bore 110 adjacent to the bolt side 114 of the trunnion 106. When disposed in the barrel side 112 of the trunnion 106, the barrel nut assembly 108 can abut the internal lip 116 of the trunnion 106. Advantageously, the internal lip 116 is configured to hold the barrel nut assembly 108 in the trunnion and not allow the barrel nut assembly 108 to move through the bolt side 114 of the trunnion 106.

The barrel nut assembly 108 can include an outer barrel nut sleeve 118 and an inner barrel nut sleeve 120. The outer barrel nut sleeve 118 can be configured to be slidably inserted into the central bore 110 of the trunnion 106. Accordingly, the outer barrel nut sleeve 118 can have a shape and dimensions that are analogous to a shape and dimensions of the central bore 110 such that the outer barrel nut sleeve 118 can be securely nested within the central bore 110. The outer barrel nut sleeve 118 and the central bore 110 can include apertures 119 configured to guide and support a gas tube or line (not shown). Advantageously, nesting of the outer barrel nut sleeve 118 within the trunnion 106 can militate against rotation of the barrel nut assembly within the trunnion 106 while also allowing the barrel nut assembly 108 to be selectively removed from the chassis 102.

Figure 5:
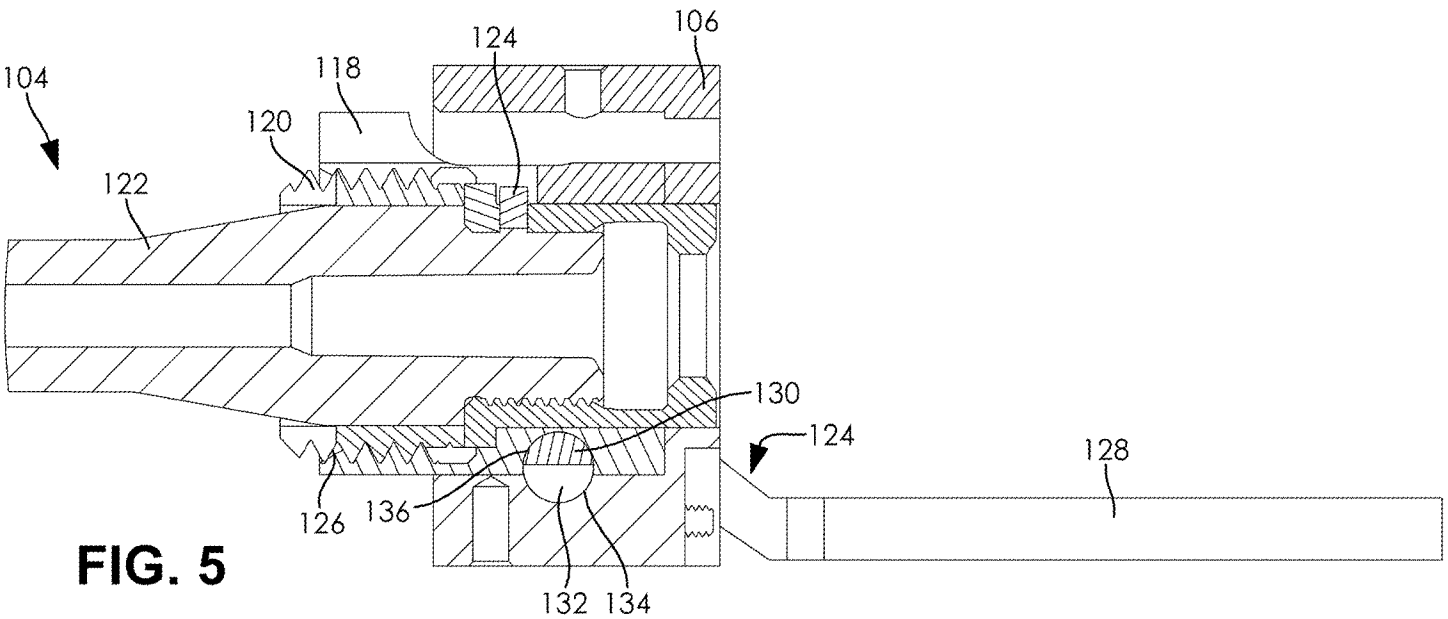
FIG. 5 is a cross sectional, partial, side elevational view of the barrel assembly, taken at callout 5 in FIG. 2.

The outer barrel nut sleeve 118 and the inner barrel nut sleeve 120 can cooperate to secure a barrel 122 within the trunnion 106. In particular, the inner nut barrel sleeve 120 can be disposed around the barrel 122, and the inner nut barrel sleeve 120 and the barrel 122 can be disposed in the outer barrel nut sleeve 118. The barrel 122 can be further secured with a pin 124. The inner barrel nut sleeve 120 can be secured into the outer barrel nut sleeve 118 through cooperating threads 126 on each of the barrel nut sleeves 118, 120, for example, as shown in FIG. 5.

Figure 3:
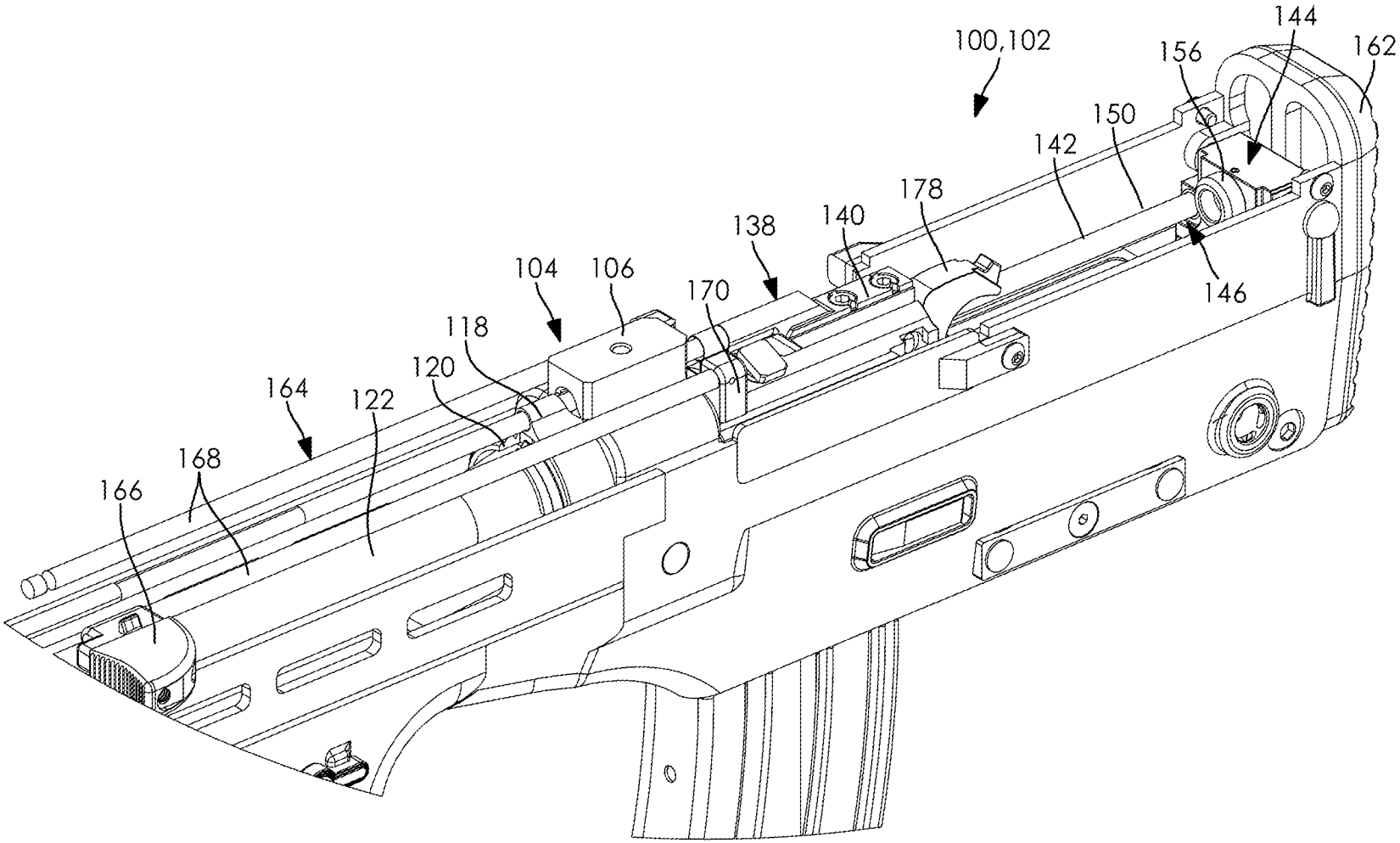
FIG. 3 is an enlarged, partial, top perspective view of the customizable firearm system of FIG. 1, further depicted with a portion of the chassis removed.
Figure 4:
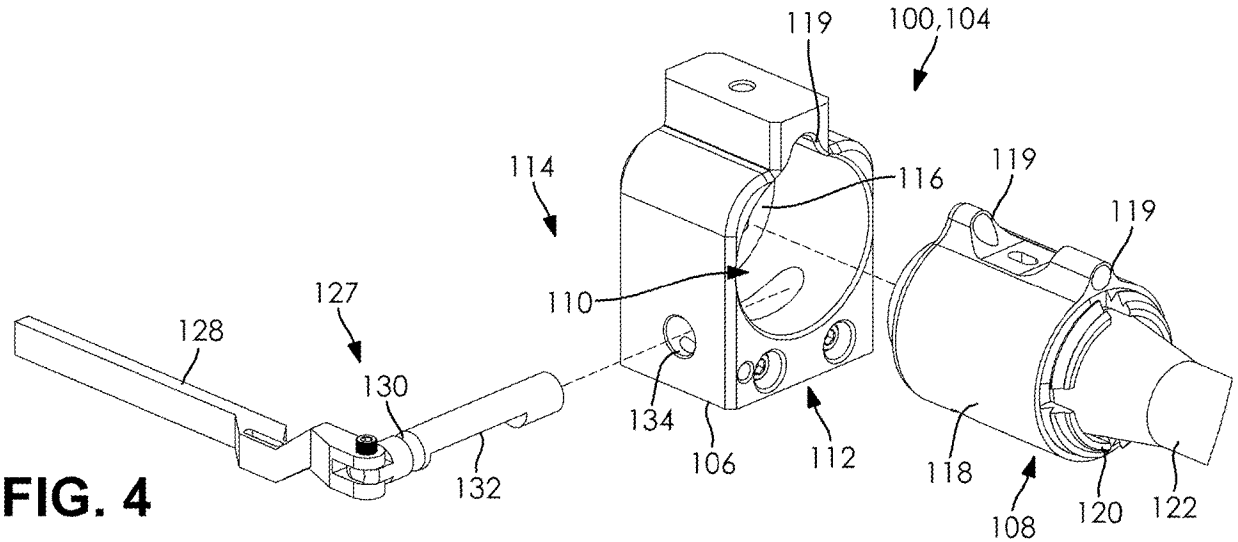
FIG. 4 is an exploded, partial, top perspective view of a barrel assembly of the customizable firearm system of FIG. 1, further depicted removed from the chassis.

In operation, when assembling the barrel assembly 104, the barrel 122 can be inserted into the outer barrel nut sleeve 118, and the inner barrel nut sleeve 120 can be disposed around the barrel 122 and in the outer barrel nut sleeve 118. The inner barrel nut sleeve 120 can then be twisted into place along the threads 126. In this way, the outer barrel nut sleeve 118 and the inner barrel nut sleeve 120 can cooperate to secure the barrel 122 in place within the barrel assembly 104, for example, as shown in FIGS. 3-5. Advantageously, the dual sleeve barrel nut system (outer barrel nut sleeve 118 and inner barrel nut sleeve 120) can allow a standard AR barrel to be utilized with the customizable firearm system 100. Additionally, dimensions of the inner barrel nut sleeve 120 can be configured to receive additional barrel types, where corresponding changes can be made to the configuration of the outer barrel nut sleeve 118 to receive a particular barrel 122, as desired.

The barrel assembly 104 can include a release system 127. The release system 127 can include a lever 128 in communication with a rod 130. The rod 130 can include a cutout 132. The trunnion 106 can have a cylindrical opening 134 formed orthogonal to the central bore 110. The opening 134 can be open to the central bore 110. The outer barrel nut sleeve 118 can have a corresponding divot 136 formed therein such that the rod can be inserted into the cylindrical opening 134 and be in communication with the divot 136 of the outer barrel nut sleeve 118. The lever 128 can be configured to selectively rotate the rod 130. The lever 128 can have a free end that can be disposed on an exterior of the chassis 102, such that the lever 128 can be accessed by a user without removal of any components of the firearm 100. When rotated, the cutout of the rod 130 can be aligned with the divot 136 of the outer barrel nut sleeve 118 and the cylindrical opening 134 of the trunnion 106. When the cutout 132, cylindrical opening 134, and the divot 136 are aligned, the user can slide the barrel assembly 104 out of the chassis 102. In operation, additional components can be removed with the barrel assembly 104 including a gas tube, a gas block, and a muzzle break (not shown).

It should be appreciated that the quick-change barrel assembly 104 can be removed directly from a handrail of the chassis 102. Advantageously, the barrel system 104 can allow for a toolless removal of the barrel 122, in operation. The barrel assembly 104 can be swapped in less than a minute with no small parts at risk of being lost and does not alter the state of any other accessories or critical components of the firearm.

Figure 7:
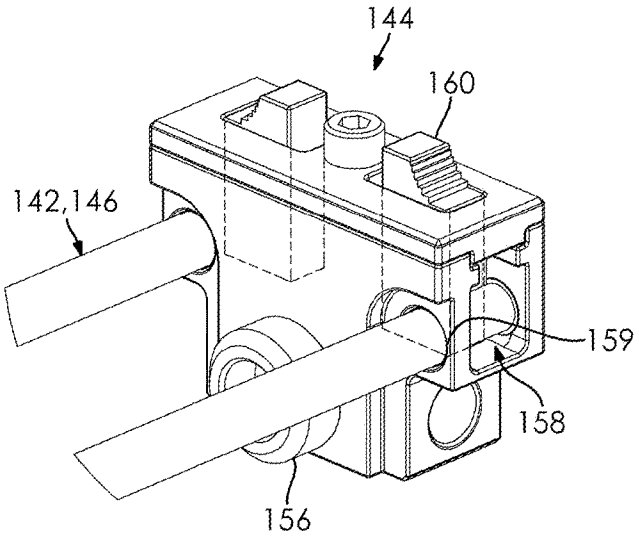
FIG. 7 is an enlarged, bottom perspective view of the end of the bolt carrier assembly of FIG. 6 including the back plate assembly.

The customizable firearm system 100 can include a removable bolt carrier assembly 138, for example, as shown in FIG. 6-8. The bolt carrier assembly 138 can include a bolt carrier 140, a pair of guide rods 142, and a backplate assembly 144. Each of the guide rods 142 can have a first end 146 and a second end 148. The first end 146 of each of the guide rods 142 can be disposed in the backplate assembly 144. The second end 148 of each of the guide rods 142 can be disposed in the bolt side 114 of the trunnion 106. As shown in FIG. 8, the second end 148 of the guide rods 142 and the trunnion 106 can have corresponding machine grooves 180, which secure the guide rods 142 in the trunnion 106 without the need of an additional fastener. The bolt carrier 140 can be slidably disposed on the pair of guide rods 142. A spring 150 can be disposed on each one of the guide rods 142 between the bolt carrier 140 and the backplate assembly 144, as shown in FIG. 3.

With reference to FIG. 6-7, the backplate assembly 144 can include a backplate 152, a pair of retaining clips 154, and a dampener 156. Each of the retaining clips 154 can include a guide rod retaining portion 158 and a finger grip 160. The guide rod retaining portion 158 can be disposed in corresponding apertures 159 in the backplate 152 and be configured to receive the guide rods 142. The finger grips 160 can extend from a bottom surface of the backplate 152.

The retaining clips 154 can be spring loaded, which allows the guide rod retaining portion 158 to push the guide rod 142 against an interior of the backplate 152. In operation, to remove the backplate assembly 144, the user can slide each one of the retaining clips 154 inward, which can release the guide rod 142 from the backplate assembly 144. Advantageously, this can allow the user to more easily replace the springs 150 on the guide rods 142.

It should be appreciated that the bolt carrier assembly 138 can be configured to be removed from the chassis 102. The chassis 102 can include a buttpad 162. The buttpad 162 can be pivotable about the chassis 102. The buttpad 162 can be secured to the chassis via a retaining pin 163. In operation, the retaining pin can be removed from the chassis 102, and the buttpad 162 can be rotated away from the chassis 102. The bolt carrier assembly 138 can be removed or otherwise accessed through an opening in a distal end of the chassis 102.

The dampener 156 of the bolt carrier assembly 138 can be fabricated from a rubberized material. The dampener 156 can be configured to receive the bolt carrier 140 following compression of the springs 150 and militate against the bolt carrier 140 contacting the backplate assembly 144. Specifically, in operation, the bolt carrier 140 can be slid on the guide rods 142, from a home position to a distal position adjacent to the backplate assembly 144. When the bolt carrier 140 is in the distal position the bolt carrier 140 is disposed against the dampener 156.

The firearm system 100 can include one or more charging handles 164 that can allow the user to move the bolt carrier assembly 138 from the home position to the distal position, in operation. Each charging handle 164 can have a grip portion 166 that extends to the exterior of the chassis 102. Each charging handle 164 can include a charging rod 168 which can have a first end disposed on a cross bar 170 of the bolt carrier 140, as shown in FIG. 3. The charging rods 168 can extend toward the barrel assembly 104 and be disposed around the trunnion 106. The grip portions 166 can be disposed on a second end of the charging rods 168.

The customizable firearm system can include a trigger mechanism 171. Advantageously, the trigger mechanism 171 can be fabricated without a bow. The trigger mechanism 171 can include a trigger 172 in communication with a trigger linkage 174. The trigger linkage 174 can be in communication with an extended trigger barrel 176. The trigger barrel 176 can be in communication with a hammer 178. A spring 182 biases the hammer 178 with respect to the extended trigger barrel 176, where the extended trigger barrel 176 can secure the hammer 178 in a cocked or spring-biased state. When the trigger 172 is pulled, moving the trigger linkage 174, the trigger linkage 174 causes the extended trigger barrel 176 to release the hammer 178 from being secured by the extended trigger barrel 176, where the hammer 178 is free to move under bias from the spring 182. The spring 182 then causes the released hammer 178 to strike a firing pin 184 in the bolt carrier assembly 138, where the firing pin 184 can move through the bolt carrier assembly 138 and strike a primer of a chambered round, if present (not shown). In operation, when the user pulls the trigger 172, the hammer 178 is released, and when a round is present and fired, subsequent reciprocation of the bolt carrier assembly 138 can compress the spring 182 and reset the hammer 178 to be secured by the extended trigger barrel 176. Reciprocation of the bolt carrier assembly 138 using the grip portion 166 of the charging handle 164 can also compress the spring 182 and reset the hammer 178 to be secured by the extended trigger barrel 176.

It should be appreciated that portions of the trigger mechanism 171 (e.g. the trigger barrel 176 and the hammer 178) can be housed in a fire control housing 184. The trigger control housing 184 can be removably disposed in a receiver 186 of the chassis 102. A pivotable door 188 can be opened to allow the user access to the fire control housing 184. Advantageously, the removable fire control housing 184 can allow the user to utilize different fire control housings 184, as desired.

It should be appreciated that the trigger mechanism 171 without a bow can allow the trigger linkage 174 to be directly connected to the trigger barrel 176. This direct connection allows the user to easily disconnect the linkage 174 to remove the fire control housing 184. This is desirable because it clears the hammer 178 from the bolt carrier assembly 138, which allows the bolt carrier assembly 138 to be slidably removed out of the chassis 102.

In certain embodiments, the customizable firearm system 100 can include the barrel assembly 104 and the bolt carrier assembly 138, each as described hereinabove. Advantageously, where both of the barrel assembly 104 and the bolt carrier assembly 138 are utilized, the firearm system 100 can allow for a total caliber change of the firearm.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A customizable firearm system, comprising:

a chassis;

a trunnion disposed in the chassis; and a bolt carrier assembly disposed in the chassis, the bolt carrier assembly including:

a backplate assembly;

a pair of guide rods, each of the guide rods having a first end disposed in the backplate assembly, and a second end disposed in the trunnion; and a bolt carrier slidably disposed on the guide rods.

2. The customizable firearm system of claim 1, wherein the backplate assembly includes a backplate, a pair of retaining clips disposed in the backplate, and a dampener.

3. The customizable firearm system of claim 2, wherein each of the retaining clips are spring loaded and include a guide rod retaining portion disposed within the backplate and a finger grip extending outwardly from a bottom surface of the backplate.

4. The customizable firearm system of claim 3, wherein the guide rod retaining portion of the retaining clip removably secures one of the guide rods into the backplate.

5. The customizable firearm system of claim 1, wherein the chassis includes an openable buttpad configured to be pivoted away from the chassis to allow access to an interior of the chassis and allow removal of the bolt carrier assembly.

6. The customizable firearm system of claim 2, wherein the bolt carrier is slidable on the guide rods from a home position adjacent to the trunnion to a distal position adjacent to the dampener of the backplate assembly.

7. The customizable firearm system of claim 1, wherein the guide rods are secured in the trunnion via corresponding grooves formed on the second end of the guide rod and an interior of the trunnion.

8. The customizable firearm system of claim 1, further comprising a trigger mechanism including a trigger in direct communication with a trigger linkage, the trigger linkage in communication with a trigger barrel, the trigger barrel in communication with a hammer, wherein the trigger is configured to move the trigger linkage, which actuates the trigger barrel, which actuates the hammer.

9. The customizable firearm system of claim 8, wherein the trigger barrel and the hammer are housed in a fire control housing, and the fire control housing is removably disposed within the chassis.

10. A customizable firearm system, comprising:

a chassis;

a barrel assembly disposed in the chassis, the barrel assembly including:

a trunnion; and a barrel nut assembly, the barrel nut assembly including an outer barrel nut sleeve and an inner barrel nut sleeve receiving a barrel, the barrel nut assembly removably disposed in the trunnion; and a bolt carrier assembly disposed in the chassis, the bolt carrier assembly including:

a backplate assembly;

a pair of guide rods, each of the guide rods having a first end disposed in the backplate assembly, and a second end disposed in the trunnion; and a bolt carrier slidably disposed on the guide rod.

* * * * *